US007900403B2

(12) United States Patent
Teckam et al.

(10) Patent No.: US 7,900,403 B2
(45) Date of Patent: Mar. 8, 2011

(54) LOG STAIRCASE AND A METHOD OF PRODUCING COMPONENTS FOR A LOG STAIRCASE

(75) Inventors: Thomas Harven Teckam, Goodman, WI (US); Torrey Wyclisse Adams, Iron Moutain, MI (US)

(73) Assignee: The Armstrong Creek Company, Inc., Goodman, WI (US)

( * ) Notice: Subject to any disclaimer, the term of this patent is extended or adjusted under 35 U.S.C. 154(b) by 699 days.

(21) Appl. No.: 11/998,756

(22) Filed: Nov. 30, 2007

(65) Prior Publication Data

US 2009/0139161 A1 Jun. 4, 2009

(51) Int. Cl.
*E02D 29/14* (2006.01)

(52) U.S. Cl. ..... 52/19; 52/182; 52/188

(58) Field of Classification Search ..... 52/182, 52/188, 191, 832, 233, 19
See application file for complete search history.

(56) References Cited

U.S. PATENT DOCUMENTS

| | | | | |
|---|---|---|---|---|
| 1,510,326 | A | | 9/1924 | Locke |
| 1,915,711 | A | | 6/1933 | Adams |
| 2,005,921 | A | | 6/1935 | Reither |
| 2,110,787 | A | | 3/1938 | Brandjord |
| 3,189,950 | A | * | 6/1965 | Johnson ..... 52/233 |
| 3,986,579 | A | | 10/1976 | Howard et al. |
| 4,096,674 | A | | 6/1978 | Kollar et al. |
| 4,706,425 | A | | 11/1987 | Brumbalough |
| 4,909,012 | A | * | 3/1990 | Thompson et al. ..... 52/745.21 |
| 5,531,048 | A | * | 7/1996 | Darling ..... 52/188 |
| 5,553,421 | A | * | 9/1996 | Stratford ..... 52/182 |
| 6,059,630 | A | * | 5/2000 | Paxton et al. ..... 446/106 |

OTHER PUBLICATIONS http://web.archive.org/web/20040716063815/http://www.woodstairsrailingslogs.com/jones.htm Jul. 16, 2004.*

* cited by examiner

*Primary Examiner* — Basil Katcheves
(74) *Attorney, Agent, or Firm* — Thomas J. Connelly; Wilhelm Law, S.C.

(57) ABSTRACT

A log staircase is disclosed along with a method of producing components for the log staircase. The log staircase includes an elongated stringer capable of angularly extending from a lower level to an upper level. The stringer has an outer circumference with a notch formed therein. A protuberance extends upward from the notch. The log staircase also includes a tread having a semicircular periphery with a flat surface. An opening is formed in the semicircular periphery of the tread. The opening is designed to mate with the protuberance to retain the flat surface crossways to the stringer. The method includes cutting a number notches and protuberances in each of a pair of stringers, and cutting a pair of openings in a predetermined number of treads which are capable of mating with the protuberances to retain each of the treads crossways to the pair of stringers.

20 Claims, 6 Drawing Sheets

LOG STAIRCASE AND A METHOD OF PRODUCING COMPONENTS FOR A LOG STAIRCASE

FIELD OF THE INVENTION

This invention relates to a log staircase and a method of producing components for a log staircase.

BACKGROUND OF THE INVENTION

The various components needed for installing a log staircase in a new log home or log building can be produced or fabricated at a manufacturer in a controlled environment. The manufacturer can produce the needed stringers, treads, etc. to specific dimensions such that the log staircase will have a particular length, height, angle of inclination, and a desired number of treads. The various components, including any needed fasteners, can then be bundled and shipped to the building site where the log staircase is to be installed. The installation of the log staircase into the new log home or log building can occur at an appropriate time in the construction cycle. This process has been successfully used in building log homes, many of which are located in remote areas. In the case of manufacturing internal and external log staircases, multiple C-shaped notches are formed in each of a pair of support stringers. Each of the C-shaped notches extends through more than half of the diameter of each stringer. Each tread or step is shaped to have a semicircular periphery with a flat surface. The flat surface forms the step portion of each tread. The semicircular periphery of each tread is designed to be positioned within one of the multiple C-shaped notches formed in each of the pair of stringers. During installation, the pair of stringers is secured in place between a lower level and an upper level. The semicircular periphery of each tread is then positioned in a pair of the C-shaped notches so as to bridge across the pair of stringers. Each tread is then shimmed and adjusted to obtain a horizontal alignment from left to right and from front to back. Once a tread is properly aligned, it is then secured in place by appropriate hardware, such as lag screws or bolts.

As is evident from the above description, the installation of such a log staircase normally requires two skilled laborers who have some previous experience with installing such log staircases. With each log staircase, it is very important that each tread or step be attached between the pair of stringers such that it lies in a horizontal plane from left to right and from front to back. Since the size and location of each C-shaped notch can vary depending upon the diameter of each stringer and because the semicircular periphery of each tread can also vary, it becomes necessary to shim and adjust each tread to obtain proper alignment. Each tread is then fastened in place to prevent movement, wobble, rotation or rocking. If the treads are not properly aligned, they can create a safety hazard to a person walking up or down the log staircase. Furthermore, if each tread is not horizontally aligned and evenly spaced from an adjacent tread, the log staircase will not pass building code.

Now, a log staircase and a method of producing components for a log staircase have been invented that allow a log staircase to be installed at a building site more quickly and efficiently, and in a manner that will satisfy building code. In addition, the log staircase can be installed by two persons that may not be skilled laborers in this task.

SUMMARY OF THE INVENTION

Briefly, this invention relates to an interior or an exterior log staircase. The log staircase includes an elongated stringer capable of angularly extending from a lower level to an upper level. The stringer has an outer circumference with one or more notches formed therein which do not extend through more than half of the diameter of the stringer. A protuberance extends upward from each of the notches. The log staircase also includes one or more treads each having a semicircular periphery with a flat surface. An opening is formed in the semicircular periphery and is aligned at an acute angle to the flat surface. The opening is capable of mating with one of the protuberances formed in the stringer to retain the flat surface of the tread crossways to the stringer.

In another embodiment, the log staircase includes a pair of elongated, spaced apart stringers. One stringer is aligned parallel to the other stringer and each stringer is capable of angularly extending from a lower level to an upper level. Each of the pair of stringers has an outer circumference with a number of notches formed therein. The notches do not extend through more than half of the diameter of each stringer. Each of the notches formed in one stringer is aligned horizontally along a common axis with one of the multiple notches formed in the other stringer. In addition, each of the notches has a protuberance extending upward therefrom. The log staircase also includes a number of treads each having a semicircular periphery with a flat surface. Each of the treads has a pair of spaced apart openings formed in the semicircular periphery with each of the openings being aligned at an acute angle to the flat surface. Each of the pair of openings is capable of mating with one of the protuberances formed in each of the stringers to retain each of the flat surfaces of the tread crossways to the pair of stringers.

The method of producing components for a log staircase includes selecting a pair of elongated, dried natural logs free of bark as stringers. Each of the pair of stringers has a length and an outer circumference with a relatively constant diameter extending along the length thereof. The outer circumference of one of the pair of stringers is similar in size to the outer circumference of the other stringer. The method also includes cutting a number of notches into the outer circumference of each of the pair of stringers. The notches do not extend through more than half of the diameter of each stringer. Each of the notches is longitudinally aligned with one another and each has a protuberance extending upward therefrom. Each of the notches formed in one of the pair of stringers is aligned horizontally along a common axis with one of the notches formed in the other stringer. The method further includes forming a predetermined number of treads equal to the number of notches formed in each of the pair of stringers. Each of the treads has a semicircular periphery with a flat surface. A pair of spaced apart openings is cut into the semicircular periphery of each of the treads and each is aligned at an acute angle to the flat surface. Each of the pair of openings is capable of mating with one of the protuberances formed in each of the pair of stringers. Lastly, the method includes gathering or bundling together the pair of stringers and the predetermined number of treads for shipment to a customer.

The general object of this invention is to provide a log staircase for connecting separate levels. A more specific object of this invention is to provide a method of producing components for a log staircase.

Another object of this invention is to provide an interior or an exterior log staircase which can be easily assembled at a building site.

A further object of this invention is to provide a log staircase for a log home or log building which requires less time to assemble at a building site.

Still another object of this invention is to provide a log staircase which allows each tread to be horizontally secured from left to right and from front to back to a pair of stringers.

Still further, an object of this invention is to provide a log staircase which utilizes a pair of openings formed in each of the treads wherein each opening is designed to mate with a protuberance formed in each of the pair of stringers to provide a secure attachment therebetween.

Other objects and advantages of the present invention will become more apparent to those skilled in the art in view of the following description and the accompanying drawings.

DETAILED DESCRIPTION OF THE INVENTION

Figure 1:
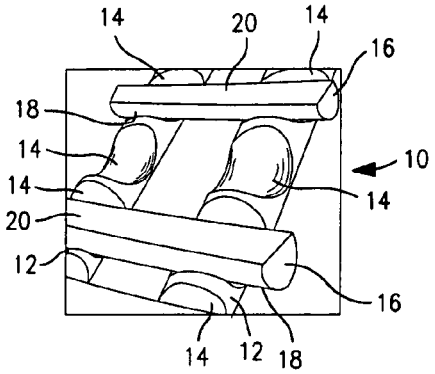
FIG. 1 PRIOR ART
FIG. 1 is a perspective view of a prior art log staircase showing a pair of log stringers each having multiple C-shaped notches cut therein which extend through more than half of the diameter of each stringer and with a semicircular tread removed to show a close up view of two of the C-shaped notches.

Referring to FIG. 1, a prior art log staircase 10 is shown which includes a pair of spaced apart log stringers 12 each having an outer diameter of approximately the same diameter. Each log stringer 12 has multiple C-shaped notches 14 cut therein. Each C-shaped notch 14 removes more than 50% of the material forming the outer diameter at that particular location. A number of wooden treads 16, equal to the number of multiple C-shaped notches 14 formed in each log stringer 12, are horizontally positioned across the pair of log stringers 12. Each of the wooden treads 16 has a semicircular periphery 18 with a flat upper surface 20. The semicircular periphery 18 of each wooden tread 16 is positioned in a pair of the C-shaped notches 14 and is secured in place by appropriate hardware (not shown), such as lag screw, bolts, etc. One drawback with this design is that the semicircular periphery 18 of each wooden tread 16 is not perfectly round and therefore is able to move, wobble, rotate and/or rock within the pair of C-shaped notches. Because of this, shims must be inserted and adjustment need to be made to ensure that each wooden tread 16 lies in a horizontal plane within a pair of the C-shaped notches 14. Each wooden tread 16 must be horizontally aligned from left to right and from front to back. Furthermore, each wooden tread 16 must be at a set vertical distance from an adjacent wooden tread 16 in order to satisfy existing building code. Once the wooden treads 16 are properly adjusted, appropriate hardware is used to secure each of the wooden treads 16 to the pair of stringers 12.

Figure 2:
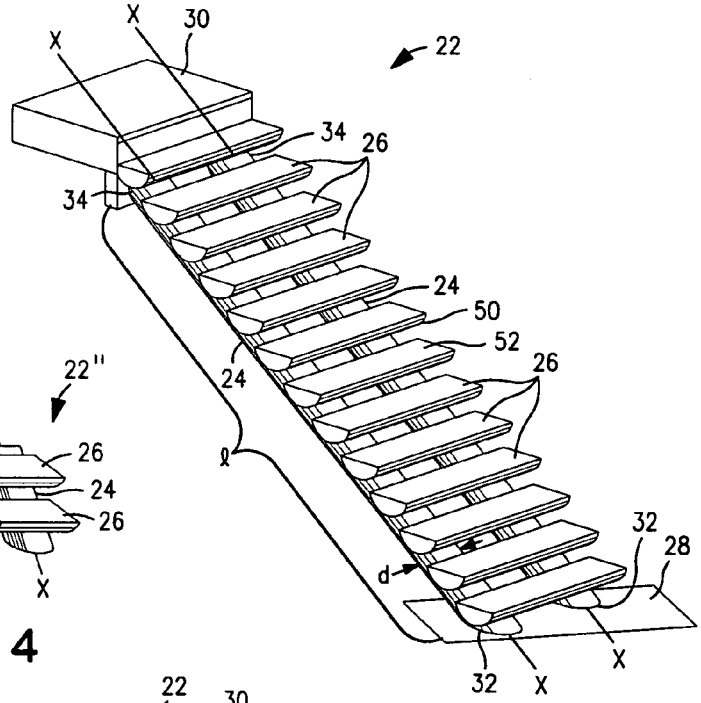
FIG. 2 is a perspective view of a log staircase installed between a lower level and an upper level and showing 13 semicircular treads secured to a pair of spaced apart log stringers.

Referring to FIG. 2, a log staircase 22 is shown which can be either an interior log staircase or an exterior log staircase. By "interior log staircase" it is meant a log staircase that is installed within a home, building or other structure. By "exterior log staircase" it is meant a log staircase that is installed on the outside of a home, building or other structure. An exterior log staircase is usually exposed to the elements. The log staircase 22 includes at least one stringer 24 and one or more treads 26 secured to the stringer 24. In FIG. 2, a pair of spaced apart elongated stringers 24, each having approximately the same diameter, is depicted having thirteen treads 26 secured across the pair of stringers 24. The pair of stringers 24 is aligned parallel to one another and they can be spaced apart by any desired distance. A distance of from about 1 foot to about 5 feet is common. The pair of stringers 24 is typically installed at an angle ranging anywhere from between about 20 degrees to about 55 degrees. The pair of stringers 24 angularly extends between a lower level 28 and an upper level 30. For example, the lower level 28 can be a ground floor and the upper level 30 can be a second floor. Alternatively, the lower level 28 can be a basement, the ground floor, a first floor, a first landing, a second floor, etc. and the upper level 30 can be the first floor, a porch, a second floor, a second landing, an attic, etc. Wherever situated, the upper level 30 is located vertically above to the lower level 28.

Each of the pair of stringers 24 is depicted as having an outer circumference and an overall cylindrical shape. By "outer circumference" it is meant a boundary line of a circle, figure, area or object. Each stringer 24 has a first end 32 and a second end 34. Each of the stringers 24 has a longitudinal central axis X-X and a length l measured between the first and second ends, 32 and 34 respectively. The length l of a stringer 24 can vary depending upon the height, width and angle of inclination of the log staircase as well as the material from which each stringer 24 is formed.

As shown in FIG. 2, each stringer 24 is depicted as a full wooden natural log. The log can be from a hardwood tree or from a softwood tree. The log can come from various trees or shrubs, including but not limited to: conifers, white cedar, red cedar, Northern white pine, Norway or red pine, Southern yellow pine, lodge pole pine, jack pine, Douglas fir, hemlock, oak, maple, etc. By "conifer" it is meant any of various mostly needle-leaved or scale-leaved, chiefly evergreen, cone-bearing gymnospermous trees or shrubs, such as pines, spruces and firs. By "cedar" it is meant any of several Old World evergreen coniferous trees of the genus Cedrus, having stiff needles and large seed cones or any of several other evergreen coniferous trees or shrubs, such as the incense cedar or red cedar. In addition, each stringer 24 can be constructed of metal, iron, aluminum, a metal alloy, thermoplastics, composite materials, fiberglass, reinforced fiberglass, etc. or be formed from one or more materials that is covered or wrapped in a wood veneer or a material appearing to be wood. By "veneer" it is meant a thin surface layer, as of wood, glued to a base material or a decorative facing. Desirably, each stringer 24 is constructed from a full log that has had the bark removed. The log can be dried such as by air drying, kiln drying or by a combination of both air and kiln drying. The log can be left unfinished or it can be coated, stained or painted with a lacquer, shellac, a varnish or some other coating or paint. By "lacquer" it is meant any of various clear or colored synthetic coatings made by dissolving cellulose derivatives together with plastizers in volatile solvents and used to impart a high gloss to the surface. By "shellac" it is meant a thin varnish made by dissolving this substance in denatured alcohol, used to finish wood. By "varnish" it is meant a paint containing a solvent and an oxidizing or evaporating binder, used to coat a surface with a hard, glossy transparent film.

Optionally each stringer 24 can be a full wooden log that has been mechanically peeled to give it the appearance of having been hand peeled. In past years, logs were scraped with a hand tool, such as a draw knife, to remove the bark and/or to shape the diameter of the log. After the logs were peeled or scraped, they exhibited shave marks on the outer surface which are now considered to be aesthetically pleasing in appearance. In addition, most logs contain one or more cracks, checks, knots, etc. which will enhance the rustic appeal of the log but which do not compromise its structural integrity. Desirably, such cracks, checks, knots etc. should be left in their natural state and should not be covered up.

Still referring to FIG. 2, each stringer 24 has a diameter d which is relatively constant along its length l. The diameter d can range from between about 6 inches to about 13 inches. Desirably, the diameter d of each stringer 24 ranges from between about 8 inches to about 12 inches. More desirably, the diameter d of each stringer 24 ranges from between about 9 inches to about 11 inches. Most desirably, the diameter d of each stringer 24 is about 10 inches. Due to the removal of any bark and/or the mechanical peeling process mentioned above, the outer circumference of each stringer 24 will not be perfectly round and the diameter d will not be a constant from the first end 32 to the second end 34. However, each stringer 24 will have a generally cylindrical shape of a relatively constant diameter d, plus or minus a couple of inches, from the first end 32 to the second end 34. In addition, when two or more stringers 24 are utilized, each of the stringers 24 should have a diameter d and an outer circumference which are similar, although not identical, in size to the other stringers 24.

Figure 3:
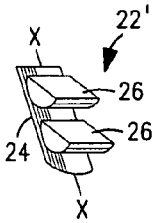
FIG. 3 is a perspective view of an alternative embodiment of a log staircase having a single log stringer and two treads.

Referring now to FIG. 3, a log staircase 22' is shown having a single stringer 24 having two treads 26 secure to it. Each of the treads 26 extend crossways or perpendicular to the longitudinal central axis X-X of the stringer 24. In addition, the upper tread 26 is vertically spaced a set distance above the lower tread 26.

Figure 4:
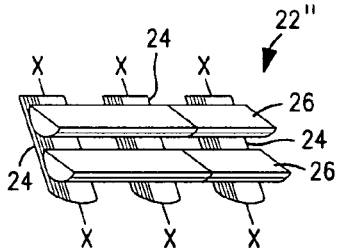
FIG. 4 is a perspective view of still another embodiment of a log staircase having three log stringers and two treads.

Referring to FIG. 4, a log staircase 22" is shown having three spaced apart stringers 24 aligned parallel to one another. Two treads 26 are secure across the three stringer 24 in a crossways or perpendicular fashion relative to the longitudinal central axis X-X of each stringer 24. Each of the three stringers 24 can be equally spaced apart from an adjacent stringer 24 or one of the stringers 24 can be aligned closer to one of the other stringers 24, if desired. Similar to the embodiment shown in FIG. 3, the upper tread 26 is vertically spaced a set distance above the lower tread 26.

Figure 5:
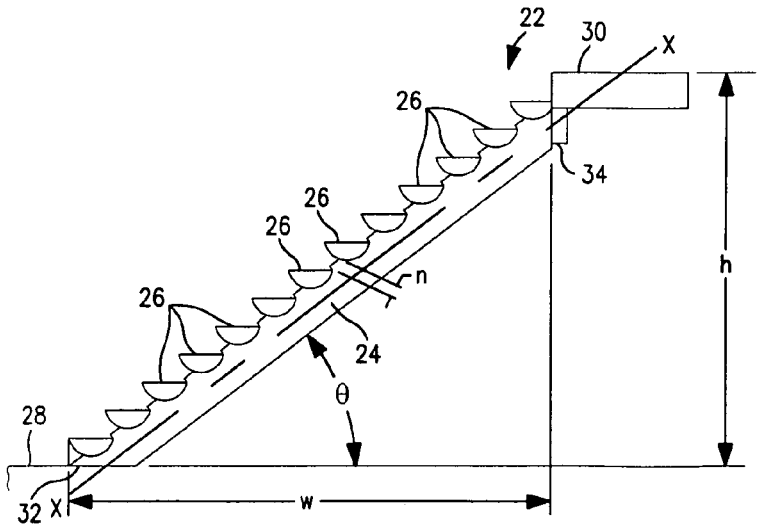
FIG. 5 is a side view of the log staircase shown in FIG. 2 depicting how each tread is positioned relative to each log stringer and showing adjacent treads separated by a set distance.

Referring now to FIG. 5, a side view of the log staircase 22 is depicted. The log staircase 22 has a height h, a width w and an angle of inclination θ. The height h is measured as the vertical distance from the lower level 28 upon which the first end 32 of each stringer 24 rests to the upper level 30 which includes the height of the beams, supports, flooring, etc. used to construct the floor of the upper level 30. The width w is measured as the horizontal distance between an outer edge of the first end 32 to an outer edge of the second end 34. The angle of inclination θ is measured between the lower level 28 and the lower surface of each stringer 24. The angle of inclination θ is depicted at approximately 38.5 degrees in FIG. 5. However, as mentioned above, the angle of inclination θ can vary to allow the log staircase 22 to fit within the dimensions provided by an architect. For safety reasons, the angle of inclination θ should not exceed 55 degrees. One will also notice that in FIG. 5, the elongated stringer 24 has a longitudinal central axis X-X and all of the thirteen treads 26 are secured to the stringer 24 such that they are all located on one side of the longitudinal central axis X-X. It should be understood that the number of treads 26 and the spacing between adjacent treads 26 can vary to suit one's particular requirements and the building codes of a particular jurisdiction. In FIG. 5, the log staircase 22 has a nominal spacing value n. The nominal spacing value n is the distance measured between the inward edge of a lower tread 26 and the lower edge of the adjacently located upper tread 26 at a point where the upper tread 26 intersects the outer circumference of the stringer 24. The nominal spacing value n can vary to suit one's particular requirements. The nominal spacing value n can range from between about 3 inches and 5 inches. In FIG. 5, the nominal spacing value n is approximately 3.4 inches.

Phrased another way, each of the notches 36 formed in a stringer 24 should be spaced at least about 2 inches apart from an adjacent notch 36 when measured parallel to the longitudinal central axis X-X. Desirably, each of the notches 36 formed in a stringer 24 should be spaced at least about 2.25 inches apart from an adjacent notch 36 when measured parallel to the longitudinal central axis X-X. More desirably, each of the notches 36 formed in a stringer 24 should be spaced at least about 2.5 inches apart from an adjacent notch 36 when measured parallel to the longitudinal central axis X-X. When two or more stringers 24 are utilized, the notches 36 formed in each of the stringers 24 should be spaced at least about 2 inches apart from an adjacent notch 36 when measured parallel to the longitudinal central axis X-X.

Referring now to FIGS. 6-10, the elongated stringer 24 has a relatively constant diameter d and an outer circumference. The outer circumference can be approximately round, circular, oval, elliptical, have a racetrack configuration or have some other geometrical configuration. Typically, the outer circumference is irregular in shape and is not completely round or circular. This is especially true if the log has been subjected to a peeling process. The stringer 24 also has at least one notch 36 formed therein which does not extend more than 50% through the diameter of the stringer 24. Desirably, the stringer 24 will have from between two to fifteen notches 36. More desirably, the stringer 24 will have from between three and thirteen notches 36. If the stringer 24 is used for an exterior staircase 22, then it will usually have fewer notches 36 than if it was used to form an interior staircase 22. One reason for this is that an exterior staircase 22, such as from the ground to a porch will normally only have one to six steps while an interior staircase 22 spanning between a ground floor and the next upper floor will usually have eight to thirteen steps.

Figure 6:
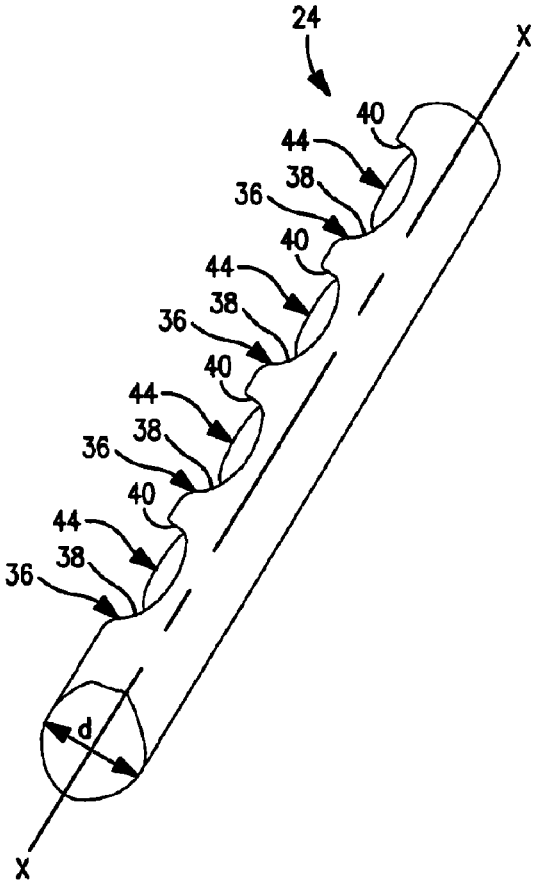
FIG. 6 is a perspective view of a log stringer having an outer circumference with a number of notches cut therein, each notch having a protuberance extending upward therefrom.

In FIG. 6, the stringer 24 is depicted as having four spaced apart notches 36 although additional notches 36 can be utilized if more steps are required. A notch 36 will be formed in each stringer 24 so as to correspond to the number of treads 26 required for a particular log staircase 22, 22' or 22". Desirably, from one to fifteen notches 36 are formed in a staircase 22, 22' or 22". More desirably, from two to thirteen notches 36 are formed in a staircase 22, 22' or 22". However, in some staircases 22, 22' or 22" more than fifteen notches 15 can be utilized. When two or more notches 36 are present, each notch 36 will be equally spaced apart from an adjacent notch 36. The presence of multiple notches 36 can give each stringer 24 a scallop appearance. By "scallop" it is meant one of a series of curved indentations formed along at least a portion of the length of a member.

Figure 10:
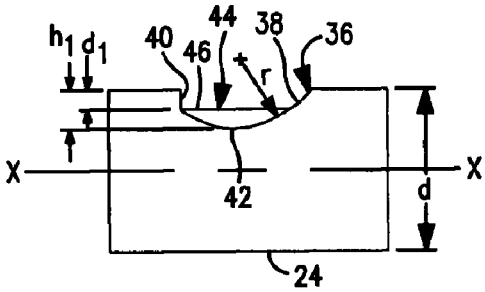
FIG. 10 is a side view of the portion of the log stringer shown in FIG. 7 taken along line 10-10 depicting the side configuration of the notch and the protuberance.

One can initially vary the size, configuration and height $h_1$ of the notches 36 one wishes to cut or machine into each stringer 24. However, when a pair of stringers 24 is utilized to form a log staircase 22, it should be understood that all of the notches 36 present in the pair of stringers 24 must be identical in size, configuration and height $h_1$. As depicted in FIG. 10, each of the notches 36 has a height $h_1$ that should be less than half of the diameter d of the stringer 24 in which it is formed. Desirably, each notch 36 is formed with a height $h_1$ that is less than 30% of the thickness of the stringer 24. More desirably, each notch 36 is formed with a height $h_1$ that is less than 25% of the thickness of the stringer 24. By forming each notch 36 to be less than half of the thickness of each stringer 24, one can obtain a stronger log staircase 22 and reduce the likelihood that the stringers 24 will flex during use of the log staircase 22. Desirably, each notch 36 has a height $h_1$ of less than about 3.5 inches. More desirably, each notch 36 has a height $h_1$ ranging from between about 1.5 inches to about 3.5 inches. Even more desirably, each notch 36 has a height $h_1$ ranging from between about 2 inches to about 3 inches. Most desirably, each notch 36 has a height $h_1$ of about 2.5 inches.

It should be understood that when two or more log stringers 24 are utilized, each log stringer 24 is aligned parallel to one another and each has at least two, and desirably, multiple notches 36 formed therein as is shown in FIGS. 2 and 4. The multiple notches 36 formed in one log stringer 24 are horizontally aligned with the multiple notches 36 formed in the other stringer(s) 24. Desirably, each notch 36 formed in one of the log stringers 24 will be horizontally aligned along a common axis with a notch 36 formed in the other log stringer 24.

Figure 7:
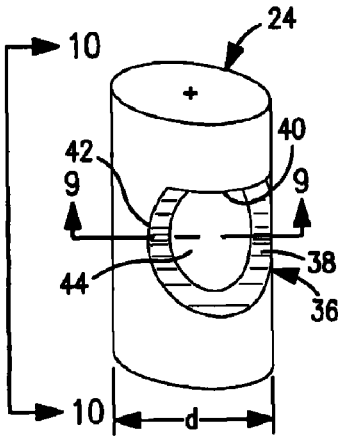
FIG. 7 is a perspective view of a portion of the log stringer shown in FIG. 6 depicting the configuration of one of the notches and the protuberance extending outward therefrom.
Figure 8:
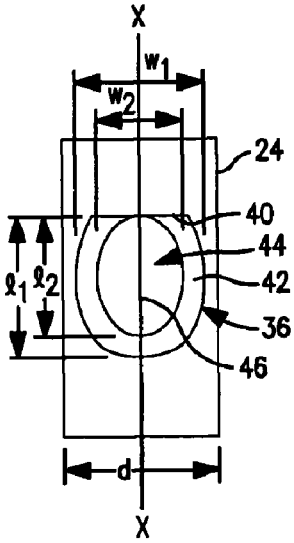
FIG. 8 is a top view of the portion of the log stringer shown in FIG. 7

As best shown in FIGS. 7-10, the notch 36 is uniquely formed. In FIG. 8, the notch 36 has a length $l_1$ and a width $w_1$. The length $l_1$ is measured parallel to the longitudinal central axis X-X while the width $w_1$ is measured perpendicular to the longitudinal central axis X-X. The length $l_1$ of the notch 36 is longer than the width $w_1$. However, the length $l_1$ of the notch 36 could be less than or equal to the width $w_1$ depending upon the configuration of the notch 36. In FIGS. 7 and 8, the notch 36 is depicted as having a partial oval configuration when viewed from the top. The notch 36 can be described as a concave cavity 38 having a squared off end 40 and a lower surface 42. The lower surface 42 is rough in finish so that it can better grip a mating tread and prevent slippage therebetween. Desirably, the lower surface 42 contains small ridges, serration or corrugations to enhance its ability to grip and retain a mating tread. The concave cavity 38 is best depicted in FIG. 10 when one views a notch 36 from the side.

Still referring to FIGS. 7 and 8, a protuberance 44 is positioned within the dimensions of the notch 36. By "protuberance" it is meant something, such as a bulge, knob or swelling that protrudes upward or outward. Each protuberance 44 has a length $l_2$ and a width $w_2$. The length $l_2$ and the width $w_2$ of each protuberance 44 is less than the length $l_1$ and the width $w_1$, respectively, of the notch 36. Each protuberance 44 can have any desired geometrical shape. In FIG. 8, the protuberance 44 is depicted as having a partial oval configuration when viewed from the top. The protuberance 44 extends upward from the lower surface 42 of the concave cavity 38, see FIG. 9. The protuberance 44 has a convex shape extending across its width $w_2$. As depicted in FIG. 8, the length $l_2$ of the protuberance 44 is of a greater dimension than the width $w_2$. However, as will be understood by those skilled in the art, the length $l_2$ of the protuberance 44 could be less than or equal to its width $w_2$, if desired, depending upon the overall configuration of the protuberance 44. The length $l_2$ of the protuberance 44 is aligned parallel to the longitudinal central axis X-X of the stringer 24 in which it is cut or formed.

Figure 9:
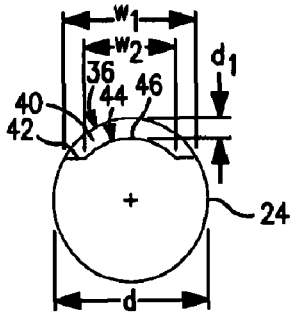
FIG. 9 is a cross-sectional view of the portion of the log stringer shown in FIG. 7 taken along line 9-9.

Referring to FIGS. 9 and 10, the protuberance 44 has an apex 46 which is located along a line that lies within the confines of the outer circumference of the stringer 24. Desirably, the apex 46 of the protuberance 44 is aligned approximately parallel to the longitudinal central axis X-X of the stringer 24. More desirably, the apex 46 of the protuberance 44 is aligned parallel to the longitudinal central axis X-X of the stringer 24, see FIG. 10. The apex 46 of the protuberance 44 can be aligned flush with or be located within the confines of the outer circumference of the stringer 24. In FIG. 9, one can see that the apex 46 is located a distance $d_1$ within the confines of the outer circumference of the stringer 24. Desirably, the apex 46 is located a distance $d_1$ of from between about 0.1 inches to about 2 inches within the confines of the outer circumference of the stringer 24. Desirably, the apex 46 is located a distance $d_1$ of from between about 0.75 inches to about 1.5 inches within the confines of the outer circumference of the stringer 24. More desirably, the apex 46 is located a distance $d_1$ of at least about 1 inch within the confines of the outer circumference of the stringer 24. The distance $d_1$ is measured perpendicular to a point which would be located on the outer circumference if the notch 36 was not present.

It should be understood that even though the apex 46 of the protuberance 44 has been explained above as being a line, it could also be a point.

Referring to FIG. 10, the notch 36 has a height $h_1$ which is measured from the bottom of the lower surface 42 to the outer circumference. This height $h_1$ can vary in dimension. Generally, for a stringer 24 having a diameter d of 13 inches or less, the height $h_a$ of the notch 36 will range from between about 1.5 inches to about 3.5 inches. Desirably, the height $h_1$ of the notch 36 will range from between about 2 inches to about 3 inches. More desirably, the height $h_1$ of the notch 36 will be about 2.5 inches. The notch 36 can also be formed with a radius r. The notch 36 can have a radius r which ranges from between about 5 inches to about 9 inches. Desirably, the notch 36 can have a radius r which ranges from between about 6 inches to about 8 inches. More desirably, the notch 36 can have a radius r which ranges from between about 6.5 inches to about 7.5 inches.

It should be noted that the above described notch 36 and protuberance 44 design is now being referred to by the manufacturer who employs the inventors as a "DUAL COPE LOG STAIRWAY". DUAL COPE LOG STAIRWAY is a State of Wisconsin registered trademark owned by The Armstrong Creek Company having an office at 612 C Avenue, Goodman, Wis. 54125.

Figure 11:
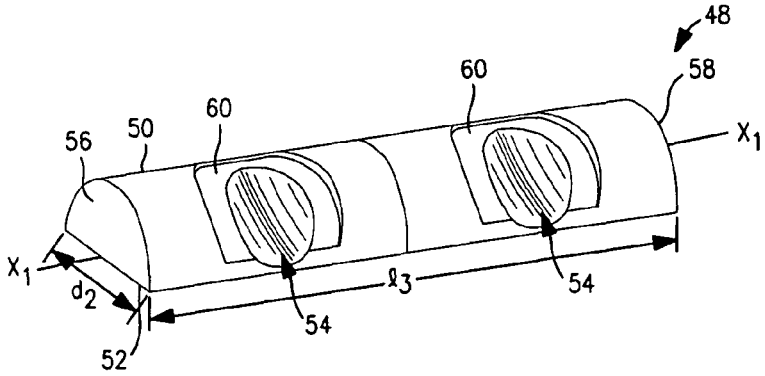
FIG. 11 is a perspective view of the bottom surface of one of the treads shown in FIG. 2 depicting a pair of spaced apart openings.
Figure 12:
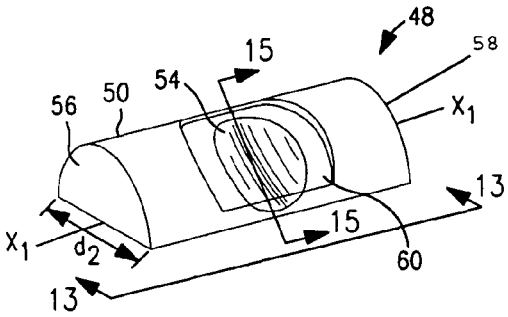
FIG. 12 is a perspective view of the left half of the tread shown in FIG. 11 showing one of the openings.
Figure 13:
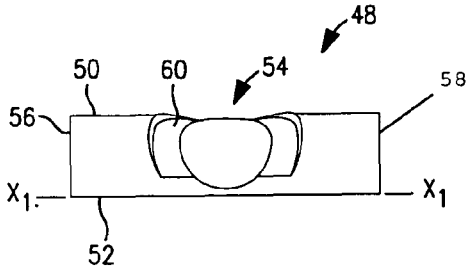
FIG. 13 is a side view of the tread shown in FIG. 12 taken along line 13-13 depicting the side configuration of the opening.

Referring now to FIG. 11, a tread 48 is shown which is designed to be secured to two spaced apart stringers 24 which are aligned parallel to one another. The tread 48 can be half of a full wooden natural log cut lengthwise. The tread 48 is identical to the tread 26 shown in FIG. 2. The tread 48 can be formed from a log which is of the same species as the logs used for the stringers 24 or it can be of a different species. Desirably, the treads 48 and the stringers 24 are from the same tree species. The tread 48 has a half round appearance with a semicircular periphery 50 and a flat surface 52. The semicircular periphery 50 may not be constant over its entire length. The tread 48 has a longitudinal central axis $X_1$-$X_1$. As with the stringers 24, each tread 48 should have any bark removed and can be processed to have a peeled appearance. Each tread 48 has a diameter $d_2$ which will correspond to the width of the flat surface 52. The diameter $d_2$ or the width of the flat surface 52 is aligned perpendicular to the longitudinal central axis $X_1$-$X_1$. The diameter $d_2$ of each tread 48 can range from between about 7 inches to about 14 inches. Desirably, the diameter $d_2$ of each tread 48 can range from between about 9 inches to about 13 inches. More desirably, the diameter $d_2$ of each tread 48 can range from between about 10 inches to about 12.5 inches. Even more desirably, the diameter $d_2$ of each tread 48 can range from between about 11 inches to about 12 inches. Typically, in designing a log staircase 22 to be both functional and aesthetically pleasing, the diameter $d_2$ or width of each tread 48 should be larger in dimension than the diameter d of each stringer 24. Desirably, each of the pair of stringers 24 has a diameter d of at least 6 inches and the flat surface 52 of each tread 48 has a width that is at least 1 inch greater than the diameter d of each of the pair of stringers 24.

Multiple treads 26 or 48 can be used to construct a staircase 22, 22' or 22". The number of treads 26 or 48 will vary depending upon the height h of the staircase 22, 22' or 22" and the vertical spacing between each of the treads 26 or 48. Typically, the number of treads 26 or 48 used in a staircase 22, 22' or 22" can range from 1 to 25 treads 26 or 48. Desirably, from one to fifteen treads 26 or 48 are present in each staircase 22, 22' or 22". More desirably, from two to thirteen treads 26 or 48 are present in each staircase 22, 22' or 22".

In FIG. 11, each tread 48 has a length $l_3$ which can vary for each log staircase. In the log staircase 22 shown in FIG. 2 wherein a pair of stringers 24 is present, each tread 26 can have a length $l_3$ which can range from between about 2 feet to about 6 feet. Desirably, when the log staircase 22 utilizes a pair of stringers 24, each tread 26 has a length $l_3$ of between about 3 feet to about 5 feet. In a log staircase 22', such as that shown in FIG. 3 having a single stringer 24, each tread 26 can have a length $l_3$ which can range from between about 1 foot to about 3 feet. Desirably, when the log staircase 22' utilizes a single stringer 24, each tread 26 has a length $l_3$ of between about 1.5 feet to about 2.5 feet. In a log staircase 22", such as that shown in FIG. 4 having three stringers 24, each tread 26 can have a length $l_3$ which can range from between about 6 feet to about 14 feet. Desirably, when the log staircase 22" utilizes three stringers 24, each tread 26 has a length $l_3$ of between about 8 feet to about 12 feet.

Referring to FIG. 2, the flat surface 52 of each tread 26 forms the upper portion of each step when assembled into the log staircase 22, 22' or 22". The semicircular periphery 50 of each tread 26 will form the lower or underneath portion of each step of the assembled log staircase 22, 22' or 22".

Returning to FIG. 11, one or more openings 54 are formed in the semicircular periphery 50. The number of openings 54 will correspond to the number of stringers 24 the log staircase 22, 22' or 22" will utilize. For example, in FIG. 3, one opening 54 is formed in each tread 26; in FIG. 4, three openings 54 are formed in each tread 26; and in FIG. 2, two openings 54 are formed in each tread 26. The openings 54 can vary in configuration. In FIG. 11 each of the openings 54 has the appearance of a concave pocket. The openings 54 are aligned at an acute angle to the flat surface 52. By an "acute angle" it is meant an angle of less than 90 degrees. In FIG. 11, two openings 54 are depicted, each spaced apart by the same distance that the pair of stringers 24 will be spaced apart. Each of the openings 54 is aligned perpendicular to the longitudinal central axis $X_1$-$X_1$. Each opening 54 is sized, shaped and configured to mate with one of the protuberances 44 formed in each notch 36 cut into the pair of stringers 24. By "mate" it is meant to join closely. Desirably, each opening 54 can be machined or cut so as to be slightly larger in size, from between about 0.25 inches to about 0.0375 inches larger, than the protuberance 44 it will mate with. This small size difference provides for final adjustment of each tread 48 relative to the pair of stringers 24. When each of the openings 54 mates with one of the protuberances 44 formed in each of the pair of stringers 24, the tread 48 will be secured across the pair of stringers 24 such that the flat surface 52 of each tread 48 extends horizontally crossways relative to the pair of stringers 24. By "crossways" it is meant to be or lie in a cross direction; across. Each tread 48 also has a first end 56 and a second end 58. When each of the treads 48 is securely affixed across the pair of stringers 24, the first and second ends, 56 and 58 respectively, will extend horizontally outward beyond the diameters d of each of the pair of stringers 24. The distance that each of the first and second ends, 56 and 58 respectively, can extend outward beyond the diameter d of each of the pair of stringers 24 can vary but normally will range from between about 6 inches to about 2 feet, see FIG. 2.

Figure 14:
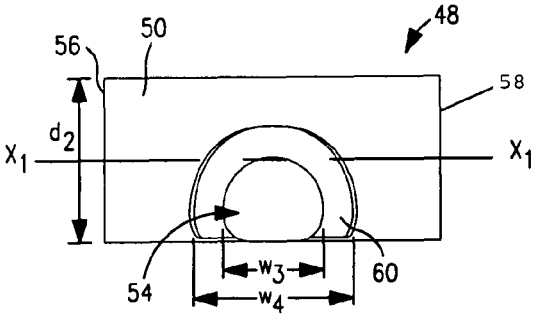
FIG. 14 is a top view of the tread shown in FIG. 12.

Referring now to FIGS. 12-15, the left half of the tread 48 is shown to better depict the configuration of one of the openings 54. As mentioned above, the opening 54 is configured as a concave pocket although other configurations can be used. In FIG. 14, the opening 54 has a width $w_3$ measured parallel to the longitudinal central axis $X_1$-$X_1$. The width $w_3$ can range from between about 4 inches to about 8 inches. Desirably, each opening 54 has a width $w_3$ which can range from between about 5 inches to about 7 inches. More desirably, each opening 54 has a width $w_3$ which can range from between about 5.5 inches to about 6.5 inches.

Still referring to FIG. 14, each opening 54 is at least partially surrounded by an enlarged pocket 60. The enlarged pocket 60 can have any desired geometrical configuration. In FIG. 14, the enlarged pocket 60 is depicted as having at least a partial oval shaped perimeter. The enlarged pocket 60 extends outward from a portion of the openings 54. Desirably, each enlarged pocket 60 extends outward in multiple directions from the periphery of at least a portion of the opening 54. Each of the enlarged pockets 60 has a width $w_4$ which is at least about 1 inch larger than the width $w_3$ of the opening 54. Desirably, each of the enlarged pockets 60 has a width $w_4$ which is at least about 2 inches larger than the width $w_3$ of the opening 54. More desirably, each of the enlarged pockets 60 has a width $w_4$ which is at least about 2.5 inches larger than the width $w_3$ of the opening 54.

Figure 15:
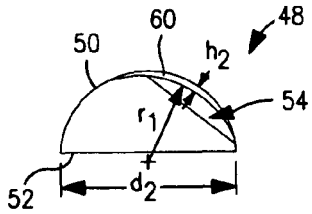
FIG. 15 is a cross-sectional view of the tread shown in FIG. 12 taken along line 15-15.
Figure 16:
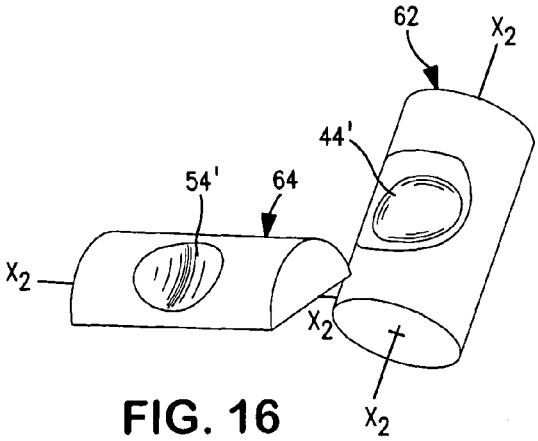
FIG. 16 is a perspective view of a portion of a log stringer and a portion of a tread showing an alternative embodiment for the notch and protuberance formed in the log stringer and an alternative embodiment for the mating opening formed in the tread.
Figure 17:
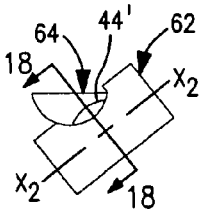
FIG. 17 is an assembly view showing the tread and log stringer shown in FIG. 16 mated together.
Figure 18:
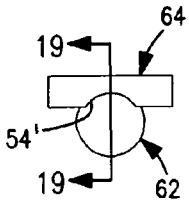
FIG. 18 is a cross-sectional view of FIG. 17 taken along line 18-18.
Figure 19:
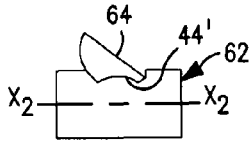
FIG. 19 is a cross-sectional view of FIG. 18 taken along line 19-19.
Figure 20:
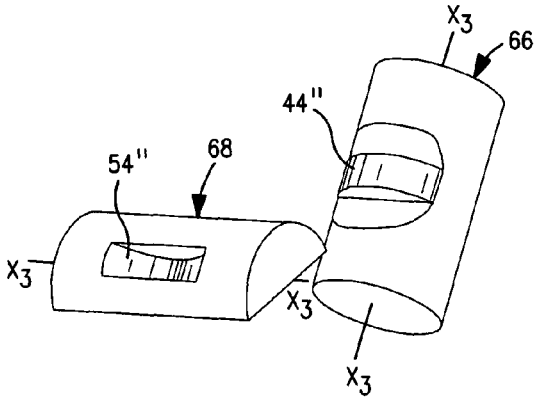
FIG. 20 is a perspective view of a portion of a log stringer and a portion of a tread showing another embodiment for the notch and protuberance formed in the log stringer and another embodiment for the mating opening formed in the tread.
Figure 21:
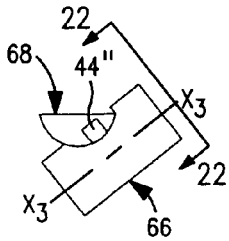
FIG. 21 is an assembly view showing the tread and log stringer shown in FIG. 20 mated together.
Figure 22:
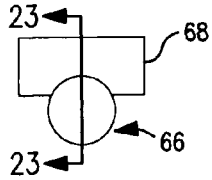
FIG. 22 is a cross-sectional view of FIG. 21 taken along line 22-22.
Figure 23:
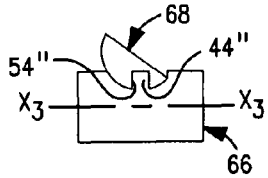
FIG. 23 is a cross-sectional view of FIG. 22 taken along line 23-23.
Figure 24:
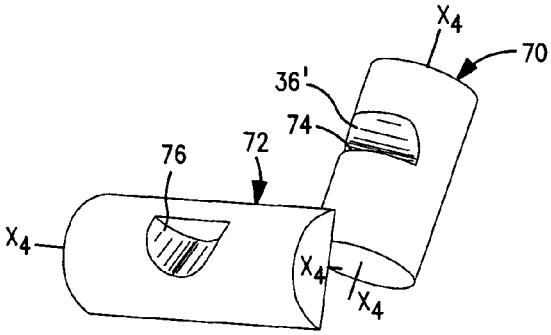
FIG. 24 is a perspective view of a portion of a log stringer and a portion of a tread showing still another embodiment for the notch and protuberance formed in the log stringer and still another embodiment for the mating opening formed in the tread.
Figure 25:
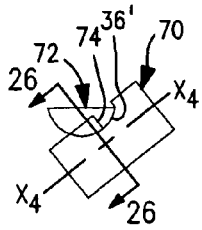
FIG. 25 is an assembly view showing the tread and log stringer shown in FIG. 24 mated together.
Figure 26:
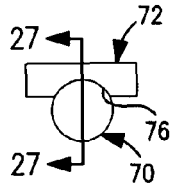
FIG. 26 is a cross-sectional view of FIG. 25 taken along line 26-26.
Figure 27:
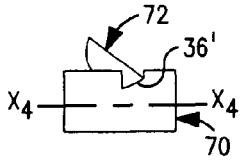
FIG. 27 is a cross-sectional view of FIG. 26 taken along line 27-27.
Figure 28:
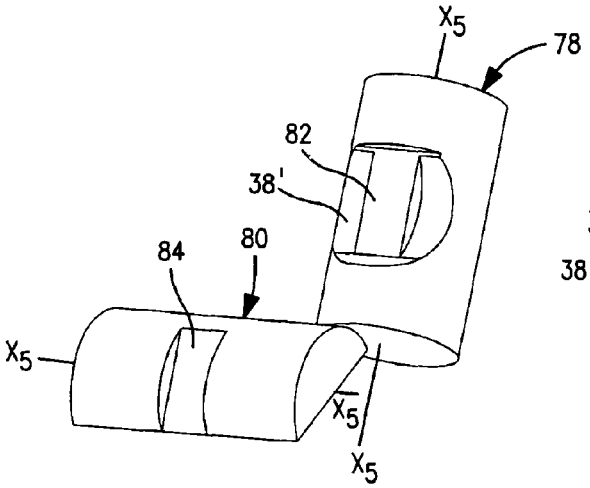
FIG. 28 is a perspective view of a portion of a log stringer and a portion of a tread showing a fourth embodiment for the notch and protuberance formed in the log stringer and a fourth embodiment for the mating opening formed in the tread.
Figure 29:
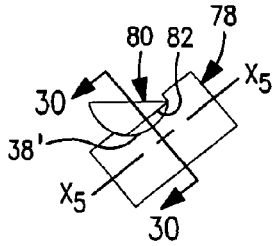
FIG. 29 is an assembly view showing the tread and log stringer shown in FIG. 28 mated together.
Figure 30:
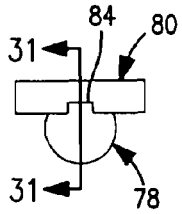
FIG. 30 is a cross-sectional view of FIG. 29 taken along line 30-30.
Figure 31:
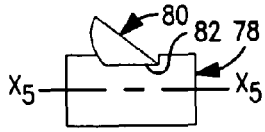
FIG. 31 is a cross-sectional view of FIG. 30 taken along line 31-31.

Referring to FIG. 15, each enlarged pocket 60 can be formed with a radius $r_1$. The enlarged pocket 60 can have a radius $r_1$ which ranges from between about 5 inches to about 9 inches. Desirably, the enlarged pocket 60 can have a radius $r_1$ which ranges from between about 6 inches to about 8 inches. More desirably, the enlarged pocket 60 can have a radius $r_1$ which ranges from between about 6.5 inches to about 7.5 inches. Each enlarged pocket 60 also has a height $h_2$ of less than about 1 inch. Desirably, each enlarged pocket 60 has a height $h_2$ of less than about 0.5 inches. The function of the enlarged pocket 60 is to mate with the concave cavity 38 of one of the notches 36 formed in each of the stringers 24. By so mating, the tread 48 can be properly situated into one of the notches 36 and the protuberance 44 can be positioned within the opening 54. During assembly of the treads 48 into the notches 36 formed in a pair of stringers 24, builders caulk, an adhesive such as a construction adhesive, glue or some other kind of binding agent known to those skilled in the art, can be used to secure the two members 36 and 48 together.

The engagement between the protuberance 44 and the opening 54 is so precise that each tread 48 is horizontally positioned relative to a pair of stringers 24. Each of the treads 48 will lie in a horizontal plane from left to right, from the first end 56 to the second end 58, and from front to back. Many state building codes specify the range of tilt from front to back of each tread 48 that is permissible before a violation is cited. In some jurisdictions, the amount of tilt is limited to about 0.25 inches. The present invention eliminates the need to use shims to obtain a horizontally level tread 48. By "shim" it is meant a thin, often tapered piece of material, such as wood, stone, or metal, used to fill gaps, make something level, or adjust something to fit properly.

Once one of the treads 48 is secured in respective horizontally aligned notches 36 between a pair of stringers 24, a small diameter pilot hole (not shown) can be drilled from the underside of the stringer 24 such that it enters into the semicircular periphery 50 of a given tread 48. A countersink or counter bore (not shown) can also be formed about the exterior surface of the pilot hole. By "countersink or counter bore" it is meant a hole with the top part enlarged so that the head of a screw or bolt will lie flush with or below the surface. The countersink or counter bore is sized to receive a wooden plug. A screw, such as a wood screw or a lag screw, or a threaded bolt (not shown) can then be screwed into the pilot hole to securely fasten the tread 48 to the stringer 24. A wooden plug is then inserted into the countersink or counter bore and is cut and/or sanded down to blend in with the semicircular periphery 50 of the tread 48 such that it becomes unnoticeable. The wooden plug can be of the same wood used to construct the stringer 24. Alternatively, a pilot hole can be drilled down through the flat surface 52 of the tread such that it enters the protuberance 44. A countersink or counter bore can also be formed about the exterior surface of the pilot hole. The countersink or counter bore is again sized to receive a wooden plug. A screw, such as a wood screw or a lag screw, or a threaded bolt (not shown) can then be screwed into the pilot hole to securely fasten the tread 48 to the stringer 24. A wooden plug is then inserted into the countersink or counter bore and is cut and/or sanded down to blend in with the flat surface 52 of the tread 48 such that it becomes unnoticeable. The wooden plug can be of the same wood used to construct the tread 48.

Referring to FIGS. 16-19, another embodiment is shown depicting a portion of a log stringer 62 having a longitudinal central axis $X_2$-$X_2$ and a portion of a tread 64 having a longitudinal central axis $X_2$-$X_2$. In this embodiment, called the wedge design, an oval shaped protuberance 44' is formed in the log stringer 62 which is aligned perpendicular to the longitudinal central axis $X_2$-$X_2$ of the log stringer 62. In addition, an oval shaped opening 54' is formed in the tread 64 which is aligned parallel to the longitudinal central axis $X_2$-$X_2$ of the tread 64. The opening 54' is slightly larger in size than the protuberance 44' to allow for minor adjustments, if necessary. The opening 54' is intended to mate with the protuberance 44' to secure the tread 64 to the log stringer 62. An adhesive or glue can also be used, as was explained above to form a more secure attachment.

Referring to FIGS. 20-23, still another embodiment is shown depicting a portion of a log stringer 66 having a longitudinal central axis $X_3$-$X_3$ and a portion of a tread 68 having a longitudinal central axis $X_3$-$X_3$. In this embodiment, called the slice design, a protuberance 44" in the shape of a portion of a narrow disc is formed in the log stringer 66 and is aligned perpendicular to the longitudinal central axis $X_3$-$X_3$ of the stringer 66. In addition, a key shaped slot opening 54" is formed in the tread 68 and is aligned parallel to the longitudinal central axis $X_3$-$X_3$ of the tread 64. The opening 54" is slightly larger in size than the protuberance 44" to allow for minor adjustments, if necessary. The opening 54" is intended to mate with the protuberance 44" to secure the tread 68 to the log stringer 66. An adhesive or glue can also be used, as was explained above to form a more secure attachment.

Referring to FIGS. 24-27, a further embodiment is shown depicting a portion of a log stringer 70 having a longitudinal central axis $X_4$-$X_4$ and a portion of a tread 72 having a longitudinal central axis $X_4$-$X_4$. In this embodiment, called the notch design, a notch 36' is formed in the log stringer 66 which has a side wall 74. The notch 36' is aligned perpendicular to the longitudinal central axis $X_4$-$X_4$ of the log stringer 66. The side wall 74 functions as a protuberance 44, 44' or 44". In this embodiment, the periphery of the side wall 74 is flush with the outer circumference of the log stringer 70 instead of being inboard of it. In addition, a concave notch 76 is formed in the tread 72 and the longest dimension of the concave notch 76 is aligned parallel to the longitudinal central axis $X_4$-$X_4$ of the tread 64. The concave notch 76 is slightly larger in size than the notch 36' to allow for minor adjustments, if necessary. The concave notch 76 is intended to mate with the notch 36' to secure the tread 72 to the log stringer 70. An adhesive or glue can also be used, as was explained above to form a more secure attachment.

Referring to FIGS. 28-31, still another embodiment is shown depicting a portion of a log stringer 78 having a longitudinal central axis $X_5$-$X_5$ and a portion of a tread 80 having a longitudinal central axis $X_5$-$X_5$. In this embodiment, called the slot design, a protuberance 82 is formed within a concave cavity 38' formed in the log stringer 78. The long dimension of the protuberance 82 is aligned parallel to the longitudinal central axis $X_5$-$X_5$ of the log stringer 78. In addition, a key shaped slot opening 84 is formed in the tread 80 and the longest dimension of the key shaped slot opening 38' is aligned perpendicular to the longitudinal central axis $X_5$-$X_5$ of the tread 80. The key shaped slot opening 84 is slightly larger in size than the protuberance 82 to allow for minor adjustments, if necessary. The key shaped slot opening 84 is intended to mate with the protuberance 82 to secure the tread 80 to the log stringer 78. An adhesive or glue can also be used, as was explained above to form a more secure attachment.

Figure 32:
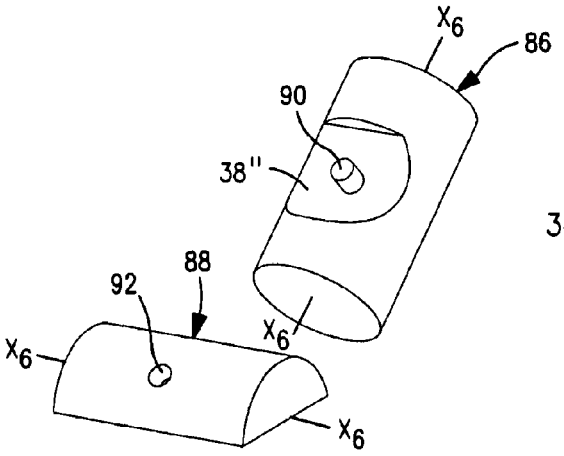
FIG. 32 is a perspective view of a portion of a log stringer and a portion of a tread showing a fifth embodiment for the notch and protuberance formed in the log stringer and a fifth embodiment for the mating opening formed in the tread.
Figure 33:
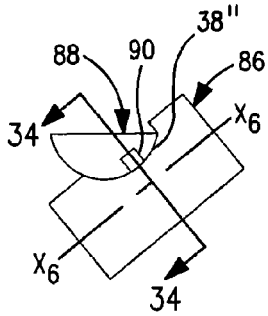
FIG. 33 is an assembly view showing the tread and log stringer shown in FIG. 32 mated together.
Figure 34:
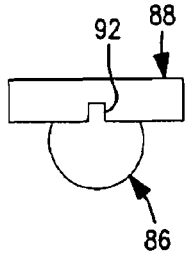
FIG. 34 is a cross-sectional view of FIG. 33 taken along line 34-34.
Figure 35:
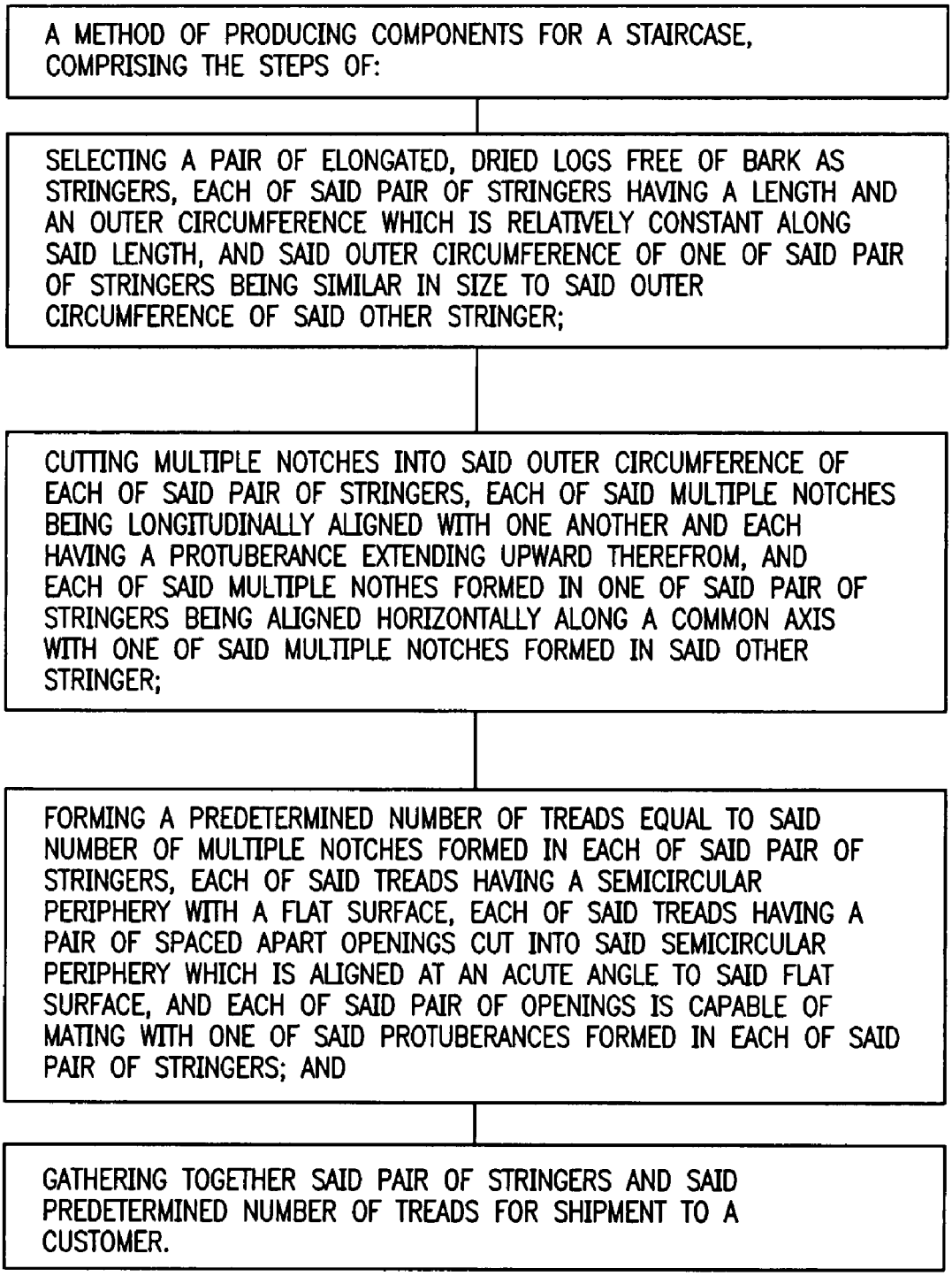
FIG. 35 is a flow diagram of a method of producing components for a log staircase.

Referring to FIGS. 32-34, a further embodiment is shown depicting a portion of a log stringer 86 having a longitudinal central axis $X_6$-$X_6$ and a portion of a tread 88 having a longitudinal central axis $X_6$-$X_6$. In this embodiment, called the dowel design, a protuberance 90 is formed within a concave cavity 38" formed in the log stringer 86. The protuberance 90 is in the shape of a dowel rod which extends outward from the center of the log stringer 86 and is aligned perpendicular to the longitudinal central axis $X_6$-$X_6$ of the log stringer 86. In addition, an aperture or opening 92 is formed in the tread 88 and the aperture 92 is aligned perpendicular to the longitudinal central axis $X_6$-$X_6$ of the tread 88. The aperture 92 is slightly larger in size than the protuberance 90 to allow for minor adjustments, if necessary. The aperture 92 is intended to mate with the protuberance 90 to secure the tread 88 to the log stringer 86. An adhesive or glue can also be used, as was explained above to form a more secure attachment.

Method

A method of producing components for a log staircase 22, 22' or 22" will now be explained. The method includes the steps of selecting a pair of elongated, dried natural logs. The logs can be conifer logs. Any bark that may be present on the logs is removed such that each log is free of bark. The logs can then be subjected to a peeling process where scraps are formed in the outer circumferences of each log to make it appear similar to a log that has been hand peeled using a draw knife. If the log staircase 22 requires a pair of stringers 24, two logs of approximately the same outer circumference and diameter d are selected. No two logs will have a constant diameter but a relatively constant diameter will suffice. Each of the pair of stringers 24 has a length and an outer circumference which is relatively constant along its length. The outer circumference of one of the pair of stringers 24 will be similar in size to the outer circumference of the other stringer 24. One or more notches 36 are cut or formed into the outer circumference of each of the pair of stringers 24. Each of the notches 36 is longitudinally aligned with the other notches 36 and each notch 36 has a protuberance 44 extending upward or outward therefrom. Each of the notches 36 formed in one of the pair of stringers 24 is aligned horizontally along a common axis with one of the notches 36 formed in the other stringer 24. The method also includes forming a predetermined number of treads 48 equal to the number of notches 36 formed in each of the pair of stringers 24. Each of the treads 48 has a semicircular periphery 50 with a flat surface 52. Each of the treads 48 has a pair of spaced apart openings 54 cut into the semicircular periphery 50 which are aligned at an acute angle to the flat surface 52. Each of the pair of openings 54 is capable of mating with one of the protuberances 44 formed in each of the pair of stringers 24. The method further includes gathering together the pair of stringers 24 and the predetermined number of treads 48 for shipment to a customer.

Optionally, the method can further include drilling apertures in each of the treads 48 such that the apertures are aligned with each of the openings or concave pockets 54. The apertures can extend from the flat surface 52 of a tread 48 or from the underside semicircular periphery 50 of a tread 48. A countersink or a counter bore can then be formed in the flat surface 52 of each of the predetermined number of treads 48. Alternatively, the countersink or a counter bore can then be formed in spherical periphery 50 of each of the predetermined number of treads 48. The countersink or counter bore will be coaxially aligned with one of the apertures and a wooden plug can be provided which can be inserted into the countersink or counter bore once a fastener has been inserted therein. The fastener will act to secure and retain the tread 48 to each of the stringers 24.

The method can further include providing a number of fasteners which can be used to secure each of the predetermined number of treads 48 to each of the pair of stringers 24.

While the invention has been described in conjunction with several specific embodiments, it is to be understood that many alternatives, modifications and variations will be apparent to those skilled in the art in light of the foregoing description. Accordingly, this invention is intended to embrace all such alternatives, modifications and variations which fall within the spirit and scope of the appended claims.

We claim:

1. A log staircase, comprising:

a) an elongated stringer capable of angularly extending from a lower level to an upper level, said stringer having an outer circumference with a notch formed therein and having a protuberance extending upward from said notch, said protuberance having a width, a partial oval configuration when viewed from the top, and a convex shape extending across said width; and b) a tread having a semicircular periphery with a flat surface and having an opening formed in said semicircular periphery which is aligned at an acute angle to said flat surface, and said opening is capable of mating with said protuberance to retain said flat surface crossways to said stringer.

2. The log staircase of claim 1 wherein said elongated stringer is a log having a longitudinal central axis and said protuberance is aligned parallel to said longitudinal central axis, and said notch is a concave cavity.

3. The log staircase of claim 2 wherein said tread is a half round log having a longitudinal central axis and said opening is aligned perpendicular to said longitudinal central axis, said opening is at least partially surrounded by an enlarged pocket, and said enlarged pocket mates with said concave cavity when said protuberance is positioned within said opening.

4. The log staircase of claim 1 wherein said elongated stringer has a first end and a second end, and a number of notches are formed between said first and second ends, each of said notches is equally spaced apart from an adjacent notch, and each of said notches has a squared off end.

5. The log staircase of claim 1 wherein said protuberance is aligned perpendicular to said elongated stringer.

6. The log staircase of claim 5 wherein said protuberance is in the shape of a dowel rod.

7. The log staircase of claim 1 further comprising a pair of elongated, spaced apart stringers aligned parallel to one another and capable of angularly extending from a lower level to an upper level, each of said pair of stringers having an outer circumference with at least two notches formed therein, each of said notches in one stringer being aligned horizontally along a common axis with a notch formed in said other stringer, and each of said notches having a protuberance extending upward therefrom, and at least two treads each having a semicircular periphery with a flat surface, each of said treads having a pair of spaced apart concave pockets formed in said semicircular periphery with each of said concave pockets being aligned at an acute angle to said flat surface, and each of said concave pockets formed in each of said treads capable of mating with one of said protuberances formed in each of said stringers to retain each of said flat surfaces crossways to said pair of stringers.

8. The log staircase of claim 1 wherein a pair of stringers is present and each of said pair of stringers has a diameter, and each of said flat surfaces of said treads has a width, and said width is greater in dimension than said diameter.

9. The log staircase of claim 8 wherein each of said pair of stringers has a diameter of at least 6 inches and each of said flat surfaces of said treads has a width that is at least 1 inch greater than said diameter of each of said pair of stringers.

10. A log staircase, comprising:

a) a pair of elongated, spaced apart stringers aligned parallel to one another and capable of angularly extending from a lower level to an upper level, each of said pair of stringers having an outer circumference with a number of notches formed therein, each of said notches in one stringer being aligned horizontally along a common axis with a notch formed in said other stringer, and each of said notches having a protuberance extending upward therefrom, each of said protuberances having a width, a partial oval configuration when viewed from the top, and a convex shape extending across said width; and b) multiple treads each having a semicircular periphery with a flat surface, each of said treads having a pair of spaced apart pockets formed in said semicircular periphery with each of said pockets being aligned at an acute angle to said flat surface, and each of said pockets formed in each of said treads capable of mating with one of said protuberances formed in each of said stringers to retain each of said flat surfaces crossways to said pair of stringers.

11. The log staircase of claim 10 wherein each of said pair of stringers has a relatively constant diameter and each of said notches has a depth which is less than half of said relatively constant diameter, and each of said notches is spaced at least 2.5 inches apart from an adjacent notch in each of said pair of stringers.

12. The log staircase of claim 10 wherein each of said pair of stringers has a longitudinal central axis, a length, and an outer circumference which is relatively constant along said length, and each of said protuberances has a length that is aligned parallel to said longitudinal central axis.

13. The log staircase of claim 10 wherein each protuberance has a length and a width, and said length is greater in dimension than said width.

14. The log staircase of claim 10 wherein each of said notches is a concave cavity having a squared off end and a lower surface.

15. The log staircase of claim 10 further comprising an enlarged pocket extending outward from a portion of each of said notches and each of said enlarged pockets having a depth of less than about 1 inch.

16. A method of producing components for a log staircase, comprising the steps of:

a) selecting a pair of elongated, dried logs free of bark as stringers, each of said pair of stringers having a length and an outer circumference which is relatively constant along said length, and said outer circumference of one of said pair of stringers being similar in size to said outer circumference of said other stringer;

b) cutting a number of notches into said outer circumference of each of said pair of stringers, each of said notches being longitudinally aligned with one another and each having a protuberance extending upward therefrom, each of said protuberances having a width, a partial oval configuration when viewed from the top, and a convex shape extending across said width, and each of said notches formed in one of said pair of stringers being aligned horizontally along a common axis with one of said notches formed in said other stringer;

c) forming a predetermined number of treads equal to said number of notches formed in each of said pair of stringers, each of said treads having a semicircular periphery with a flat surface, each of said treads having a pair of spaced apart openings cut into said semicircular periphery which are aligned at an acute angle to said flat surface, and each of said pair of openings being capable of mating with one of said protuberances formed in each of said pair of stringers; and d) gathering together said pair of stringers and said predetermined number of treads for shipment to a customer.

17. The method of claim 16 further comprising drilling apertures in each of said treads, at least one of said apertures being aligned with each of said concave pockets.

18. The method of claim 17 wherein each of said apertures extends from said flat surface to said opening.

19. The method of claim 18 wherein a countersink is formed in said flat surface of each of said predetermined number of treads about each of said apertures and a wooden plug is provided which can be inserted into said countersink once a fastener has been inserted therein for securing said tread to one of said pair of stringers.

20. The method of claim 16 further comprising providing fasteners for securing each of said predetermined number of treads to each of said pair of stringers.

* * * * *